US006109450A

United States Patent [19]

Grunenwald et al.

[11] Patent Number: 6,109,450

[45] Date of Patent: Aug. 29, 2000

[54] APPARATUS FOR SEPARATING UNWANTED CONTAMINANTS FROM FIBROUS SLURRY

[75] Inventors: Edward D. Grunenwald, Boalsburg; Ronald S. Pristash, Madera, both of Pa.

[73] Assignee: G-Wald-Taylor, Inc., State College, Pa.

[21] Appl. No.: 09/042,585

[22] Filed: Mar. 17, 1998

[51] Int. Cl.[7] ..... B07B 1/22

[52] U.S. Cl. ..... 209/270; 209/284; 209/288; 209/380; 209/395; 210/380.3; 210/402; 210/403

[58] Field of Search ..... 209/240, 241, 209/243, 247, 270, 284, 288, 293, 294, 393, 380, 395; 210/380.3, 391, 402, 403

[56] References Cited

U.S. PATENT DOCUMENTS

| | | | |
|---|---|---|---|
| 4,052,305 | 10/1977 | Arvanitakis . | |
| 4,268,381 | 5/1981 | Hooper . | |
| 4,426,289 | 1/1984 | Svehaug . | |
| 4,692,240 | 9/1987 | Arbuthnot et al. | 209/380 X |
| 4,749,475 | 6/1988 | Hooper . | |
| 4,968,417 | 11/1990 | Ahs . | |
| 4,997,558 | 3/1991 | Baker . | |
| 5,008,010 | 4/1991 | Langner . | |
| 5,019,248 | 5/1991 | Kaldor . | |
| 5,030,348 | 7/1991 | Bengt . | |
| 5,041,223 | 8/1991 | Johansson et al. . | |
| 5,133,860 | 7/1992 | Tai . | |
| 5,224,603 | 7/1993 | Hanana et al. . | |
| 5,255,790 | 10/1993 | Einoder et al. | 209/395 X |
| 5,333,801 | 8/1994 | Chambers, Sr. et al. . | |
| 5,433,849 | 7/1995 | Zittel . | |
| 5,480,546 | 1/1996 | Bergkvist et al. . | |
| 5,518,614 | 5/1996 | Zittel . | |
| 5,524,769 | 6/1996 | Spencer | 209/288 X |
| 5,547,083 | 8/1996 | Alajääski et al. . | |
| 5,547,570 | 8/1996 | Richter . | |
| 5,607,587 | 3/1997 | Langner | 209/270 X |
| 5,607,589 | 3/1997 | Frejborg . | |
| 5,624,558 | 4/1997 | Aaltonen et al. . | |

FOREIGN PATENT DOCUMENTS

| | | | |
|---|---|---|---|
| 2122111 | 1/1984 | United Kingdom | 209/288 |

OTHER PUBLICATIONS

Gary A. Smook, Handbook for Pulp & Paper Technologists, 1992, Angus Wilde Publications, Vancouver, B.C., 2nd Ed.

James E. Laughlin, P.E. and W. Clay Roming, P.E., Design of Rotary Fine Screen Facilities in Wastewater Treatment, Public Works Magazine, Apr. 1993.

Hycor Corporation, Rotostrainer, Hycor's Externally–Fed Automatic Wedgewire Screen, Apr. 1996, Lake Bluff, Illinois, USA.

Hycor Corporation, Rotoshear Internally–fed Rotary Wedgewire Screens, Jan. 1996, Lake Bluff, Illionis, USA.

Komline–Sanderson Engineering Corporation, K–S Water Tiger Screens, Web Page Sep. 3, 1997.

*Primary Examiner*—Tuan N. Nguyen
*Attorney, Agent, or Firm*—Duane, Morris & Heckscher LLP

[57] ABSTRACT

The invention provides an apparatus for screening a fibrous slurry including a rotatable drum whose circumferential wall includes a screen. The screen has spaced openings with longitudinal axes or elongations which are large relative to the transverse axes or gaps defined by the openings. The openings are disposed with their longitudinal axes extending circumferentially of the rotatable drum. The drum has at least one open end. A slurry delivery conveyor terminates adjacent to the drum for delivery of slurry within the drum.

20 Claims, 7 Drawing Sheets

APPARATUS FOR SEPARATING UNWANTED CONTAMINANTS FROM FIBROUS SLURRY

BACKGROUND OF THE INVENTION

1. Field of the Invention

The invention relates to fiber slurry screening apparatus.

2. Prior Art

Processes for separating contaminants from a pulp fiber slurry are known in the art. In a typical system, pulp-bearing materials and refuse are comminuted and mixed with a liquid, typically water, to form a slurry that becomes the influent to the process. The slurry passing through the screen contains a high proportion of fibrous pulp for further processing. However, the separated material removed by the first screen also still contains appreciable amounts of useable pulp fiber (with a higher proportion of debris than in the original influent). It is advantageous to process the screened out material further to recover some of the useable pulp fiber. Inasmuch as the filtrate that passed the screen likewise may contain particles of debris that were small enough to pass the screen in addition to the desirable pulp fiber, both the filtrate and the separated waste may advantageously be passed through secondary and tertiary screening steps to extract additional pulp fiber from separated debris, as well as to concentrate pure pulp fiber with little or no debris therein.

Various methods and apparatus have been used at secondary, tertiary or subsequent stages in the pulp reclamation process to recover useful pulp fiber from separated debris, while confining and further concentrating the debris. For example, it is known to again mix the debris with a fluid and to utilize a rotary or "drum" screening device for separating out solids at a tertiary stage of a pulp fiber reclamation system. More particularly, an internally fed, rotary drum screening device can comprise a cylindrically shaped screen, often formed of wedgewire.

The screen media comprises openings that are large enough to allow fibrous pulp to pass through, but narrow enough to trap debris in the interior of the cylinder. The drum rests and rotates on trunnions or idler wheels, and is caused to rotate about its central axis by drive means, such as an electric motor. A headbox is suspended in the interior of the rotatable drum and is connected to a source of influent slurry. Influent flows along a trough inside the drum, and spills over side weirs of the headbox onto the rotating screen. The slurry falls across the face of the wedgewire screen that forms the porous wall of the rotating drum. As water and entrained pulp pass through the screen, solids are separated from the slurry, and are caught in and become part of a tumbling mass of debris on the interior surface of the drum. An auger arrangement can be disposed along the interior of the drum and employed to move the entrained wastes axially, to be discharged at an end of the rotating drum. The filtrate and the pulp fibers therein are collected. Some form of cowling collects the filtrate that escapes through the wedgewire, and such drums can be covered by an optional full length hood so as to reduce the amount of splashing of water during the processing.

Various apparatus and methods for screening a suspension of fibrous pulp from a slurry containing undesirable debris using numerous embodiments of a rotary screening drum have been disclosed in the art. Examples include U.S. Pat. No. 4,268,381, issued to Anthony W. Hooper on May 19, 1981; U.S. Pat. No. 4,749,475, issued to Anthony W. Hooper on Jun. 7, 1988; U.S. Pat. No. 4,968,417, issued to Björn Ahs on Nov. 6, 1990; U.S. Pat. No. 4,997,558, issued to William H. Baker on Mar. 5, 1991; U.S. Pat. No. 5,008,010, issued to Herbert G. J. Langner on Apr. 16, 1991; U.S. Pat. No. 5,019,248, issued to Andrew F. Kaldor on May 28, 1991; U.S. Pat. No. 5,030,348, issued to Möller Bengt on Jul. 9, 1991; U.S. Pat. No. 5,041,223, issued to Johansson et al. on Aug. 20, 1991; U.S. Pat. No. 5,133,860, issued to Liang C. Tai on Jul. 28, 1992; U.S. Pat. No. 5,433,849, issued to David R. Zittel on Jul. 18, 1995; and U.S. Pat. No. 5,518,614, issued to David R. Zittel on May 21, 1996. Unfortunately, these and other prior art screening devices have provided less than satisfactory results due to their relatively high cost and complexity.

Moreover, it is an aspect of the present invention that the arrangement of a screen media in an internally fed screening drum has been discovered to be an important feature that advantageously can be configured in a manner not previously identified. In a typical drum screen that is adapted to capture solids, the wedgewires are attached inside the drum's rigid frame and run the length of the drum, parallel to the horizontal rotation axis of the drum and spaced from one another around the circumference. This arrangement is designed so that slurry falls onto the screen at a low angle of incidence relative to a tangent, and flows "across the grain" of the wedgewires. Inasmuch as the slurry sluices laterally across the elongated wedgewires and the openings between them, in a shearing motion, solids are unlikely to be caught between adjacent wedgewires and to clog the screen. The flat angle of incidence is such that the flow encounters a relatively reduced slot width compared to the actual circumferential gap between adjacent wedgewires (being effectively about half the actual gap).

Although reducing the tendency to clog is an advantageous feature, it is achieved in a structure that makes the drum screen more of a flow obstruction than it might be. Thus, the low angle of incidence and the flow across the wedgewires reduce the extent to which pulp fiber can be passed through the screen entrained in the liquid filtrate. To achieve a desired rate of flow of filtrate, the influent may need to be pressurized and/or the drum may be vibrated in order to improve the extraction of useable fiber from the slurry.

SUMMARY OF THE INVENTION

The present invention provides an apparatus for separating pulp from a fibrous slurry containing debris, e.g., fiber flocks, knots, wood slivers, plastics, tramp metal, stringy material, etc. The apparatus comprises a rotatable drum whose circumferential wall defines a screen. The screen has a plurality of openings having longitudinal axes which are large relative to the transverse axes of the openings. The openings are disposed with their longitudinal axes extending circumferentially relative to the rotation axis of the drum. The drum has at least one open end. A slurry delivery conveyor is also provided which terminates adjacent to the drum for delivery of slurry into the drum.

In one embodiment, the invention provides a high efficiency filter adapted to separate paper pulp from a fibrous slurry containing debris. In this embodiment, a vessel that is rotatable about an axis and adapted to receive slurry containing paper pulp comprises a wall defining a plurality of openings. The wall is radially spaced from the axis of rotation of the vessel and the openings have longitudinal axes which extend in the direction of rotation of the wall, namely circumferentially of the vessel. Advantageously, the transverse axes, which are substantially shorter than the longitudinal axes of the openings (but for attachment structures), extend parallel to the axis of rotation of the vessel. At least one end of the vessel is open for discharge of rejected solids therefrom after separation of the paper pulp from the debris.

BRIEF DESCRIPTION OF THE DRAWINGS

The foregoing and other objects, features and advantages of the invention will be more fully apparent from the following detailed description of preferred embodiments of the invention, to be considered together with the accompanying drawings wherein like numbers refer to like parts and wherein.

DETAILED DESCRIPTION OF THE PREFERRED EMBODIMENTS

Figure 1:
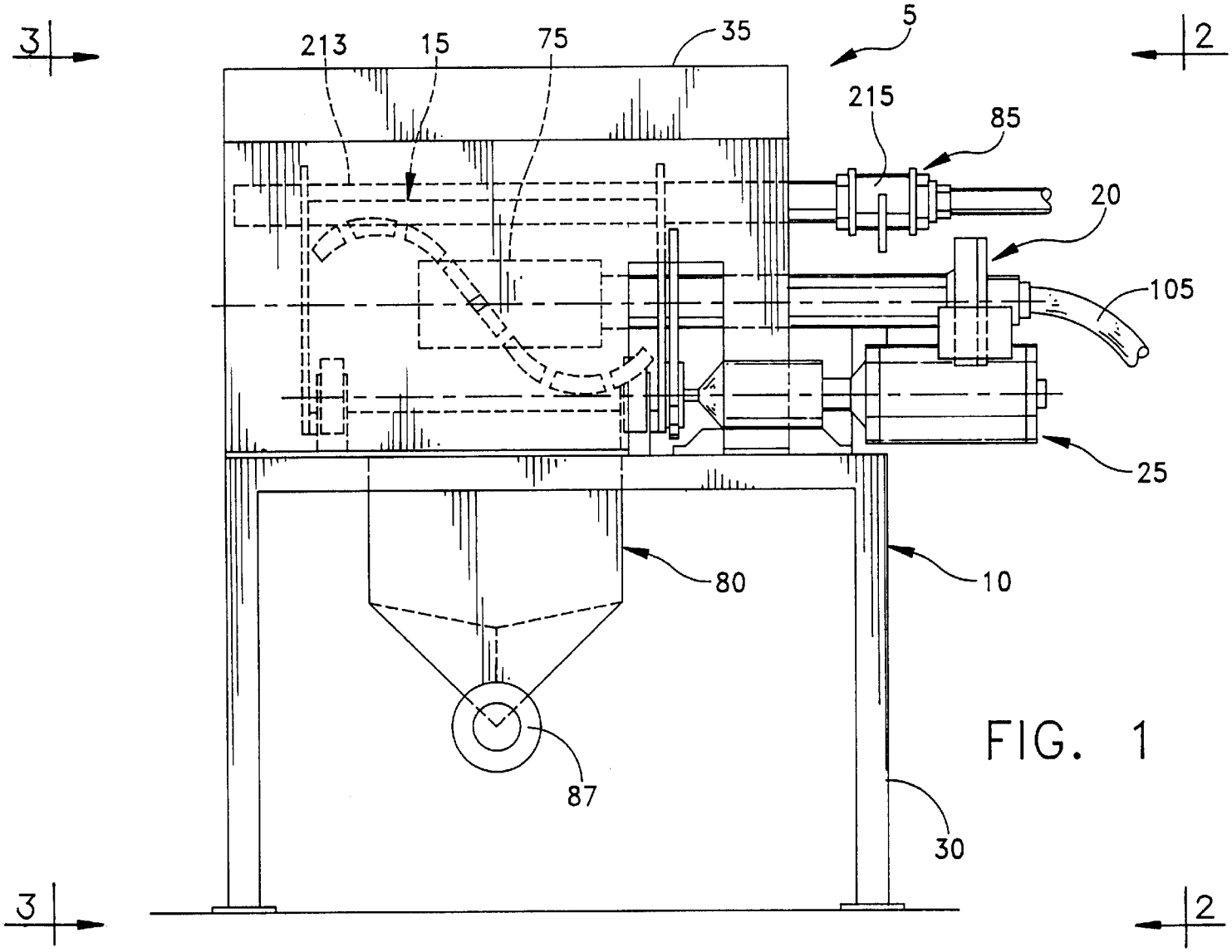
FIG. 1 is a side elevational view, partially in phantom, of a pulp fiber screening machine in accordance with the present invention.

Referring to FIG. 1, a machine 5 for separating pulp 7 from a contaminated slurry containing water or a similar fluid, the pulp and debris, includes a support 10, a screen cylinder 15, slurry control means 20, and drive means 25. Support 10 may comprise a table or bench, with or without integral legs 30, that is adapted for supporting machine 5 during operation. A splash hood 35 is disposed over screen cylinder 15 so as to prevent excess filtrate water from escaping. Splash hood 35 typically includes opposite open ends for ingress and egress of slurry and rejected material, respectively.

Referring to FIG. 1–4, screen cylinder 15 comprises a wall 40 and end flanges 43. Wall 40 forms a hollow drum having open ends 45A and 45B. Flanges 43 project outwardly from the outer surface of wall 40 adjacent to each open end 45A and 45B of screen cylinder 15. Wall 40 is formed by a screen 47 having a plurality of wires 49 wound circumferentially about the rotation axis 50 of screen cylinder 15. A plurality of longitudinally extending supporting rods 51 (FIG. 6) support wires 49 and maintain them in place so as to form a stable cylindrical wall 40. Preferably, the plurality of wires 49 are substantially parallel to one another, although some deviation from parallel (e.g., ±5°) may be employed without departing from the scope of the invention. Additionally, individual wires 49 may comprise an undulating or sinusoidal "waviness" along their length without departing from the invention as defined in the appended claims.

Figure 6:
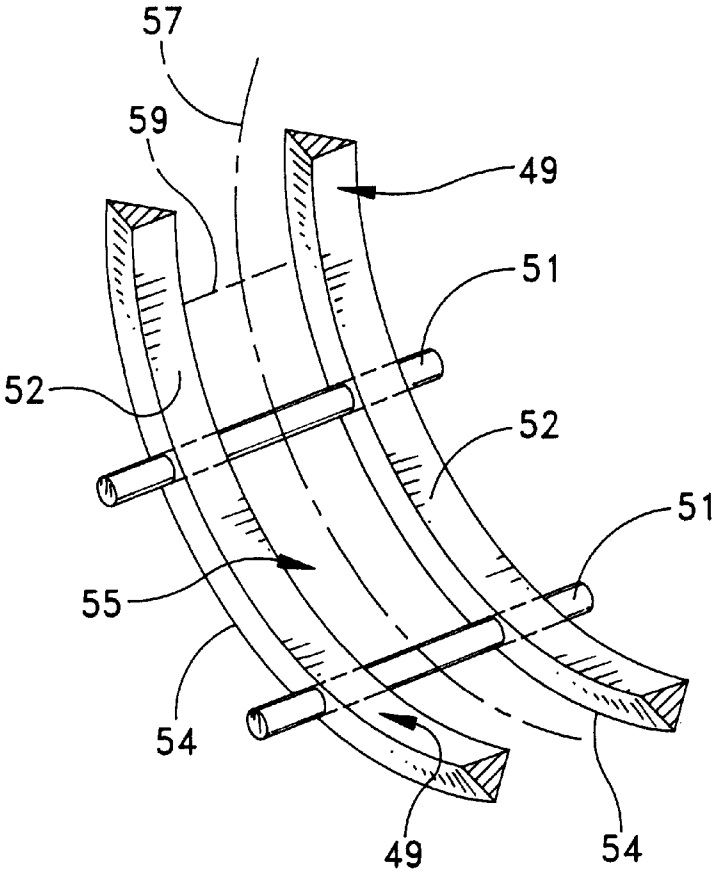
FIG. 6 is a broken-away, perspective view of a portion of a wedgewire screen.

Each wire 49 preferably comprises a conventional wedgewire that is oriented so that a broad surface 52 is directed inwardly toward rotation axis 50 of screen cylinder 15 (FIG. 6). As a result of this construction, the outwardly facing surface of wall 40 comprises a plurality of narrow edge portions 54 of wedgewires 49 arranged in substantially parallel-relation to one another, and circumferential-relation to wall 40 and rotation axis 50. Wedgewires 49 define between them a plurality of openings or gaps 55 that flare progressively more open in a direction radially outward from the rotation axis 50. Each opening has a length or longitudinal axis 57 which is large relative to the transverse axis 59 defining the width of each opening (FIG. 6). Thus, the longitudinal axes 57 of openings 55 extend circumferentially of screen cylinder 15. Openings 55 can comprise a transverse width in the range from about 0.002 to about 1.5 inches.

A refuse diverter 60 (FIG. 4) is formed by plurality of discrete inwardly projecting spiral bars that effectively form an auger in screen cylinder 15. Refuse diverter 60 aids in moving trash or debris 64 in an axial direction through screen cylinder 15 during operation of machine 5. The intermittent nature of diverter 60 has the effect of causing the entrained debris to tumble within screen cylinder 15 so as to further loosen and release trapped fiber.

Figure 9:
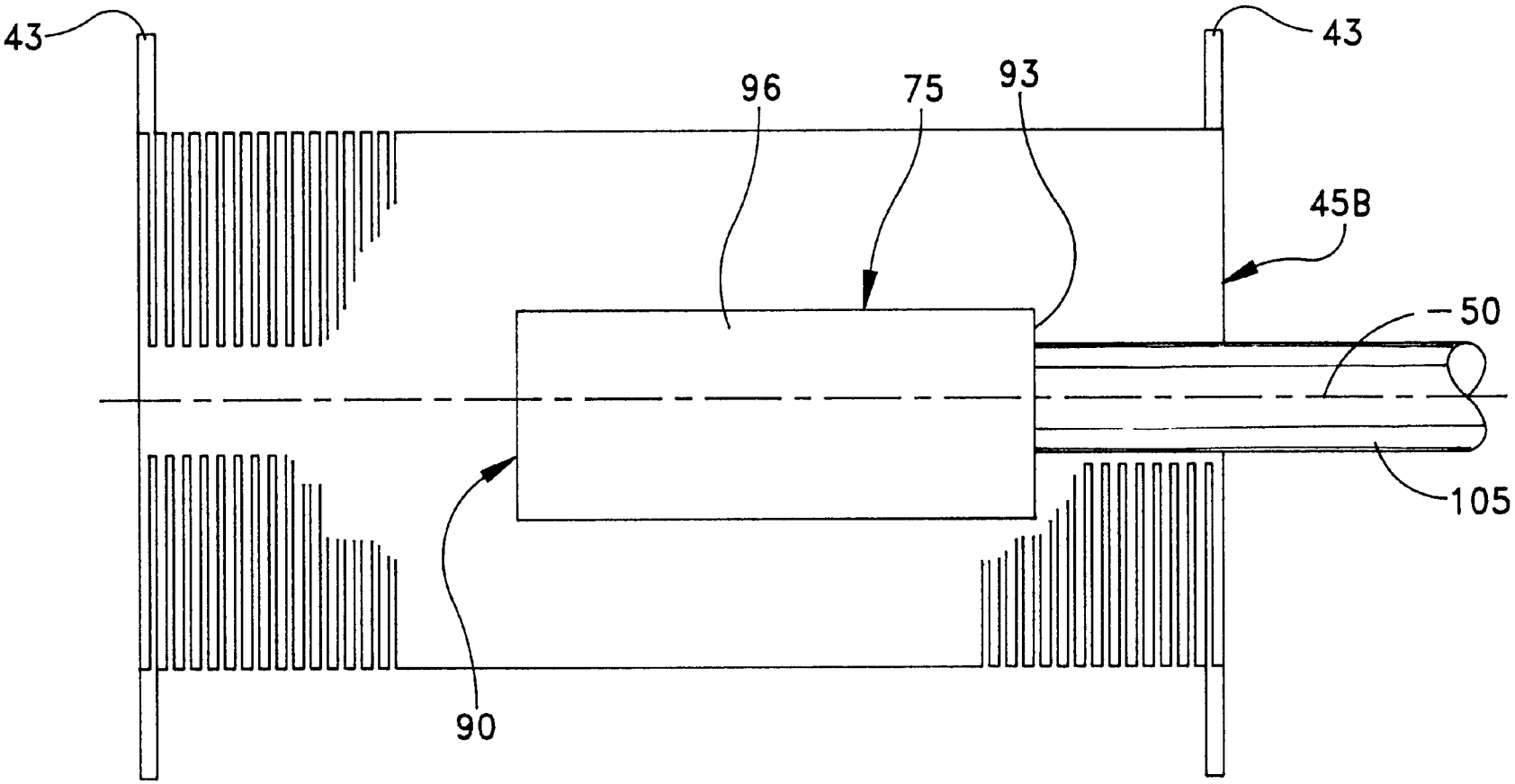
FIG. 9 is a side elevational view of an alternative embodiment of a screen cylinder.

The wedgewires 49 as shown are a preferred means for defining a plurality of openings that extend circumferentially of screen 15. Other structures may also be used in place of wedgewires 49 with similar results. For example, wall 40 may be formed from a sheet having a plurality of slots defined through its thickness, where the sheet is then bent to form a cylinder with the slots oriented circumferentially of the cylinder (FIG. 9). Each slot can be continuous or discontinuously separated by webs of material extending across the width of the slot for structural support in a manner similar to that of supporting rods 51. Also, wires 49 may have other cross-sectional shapes, e.g., elliptical, circular, prolate spheroidal, "tear-shaped", rectangular, and quadrangular, etc. However, wedgewires are preferred as they define openings that diverge radially outwardly, thus confining debris while providing a widening cross section for radially outward flow beyond their narrowest inner spacing.

Figure 2:
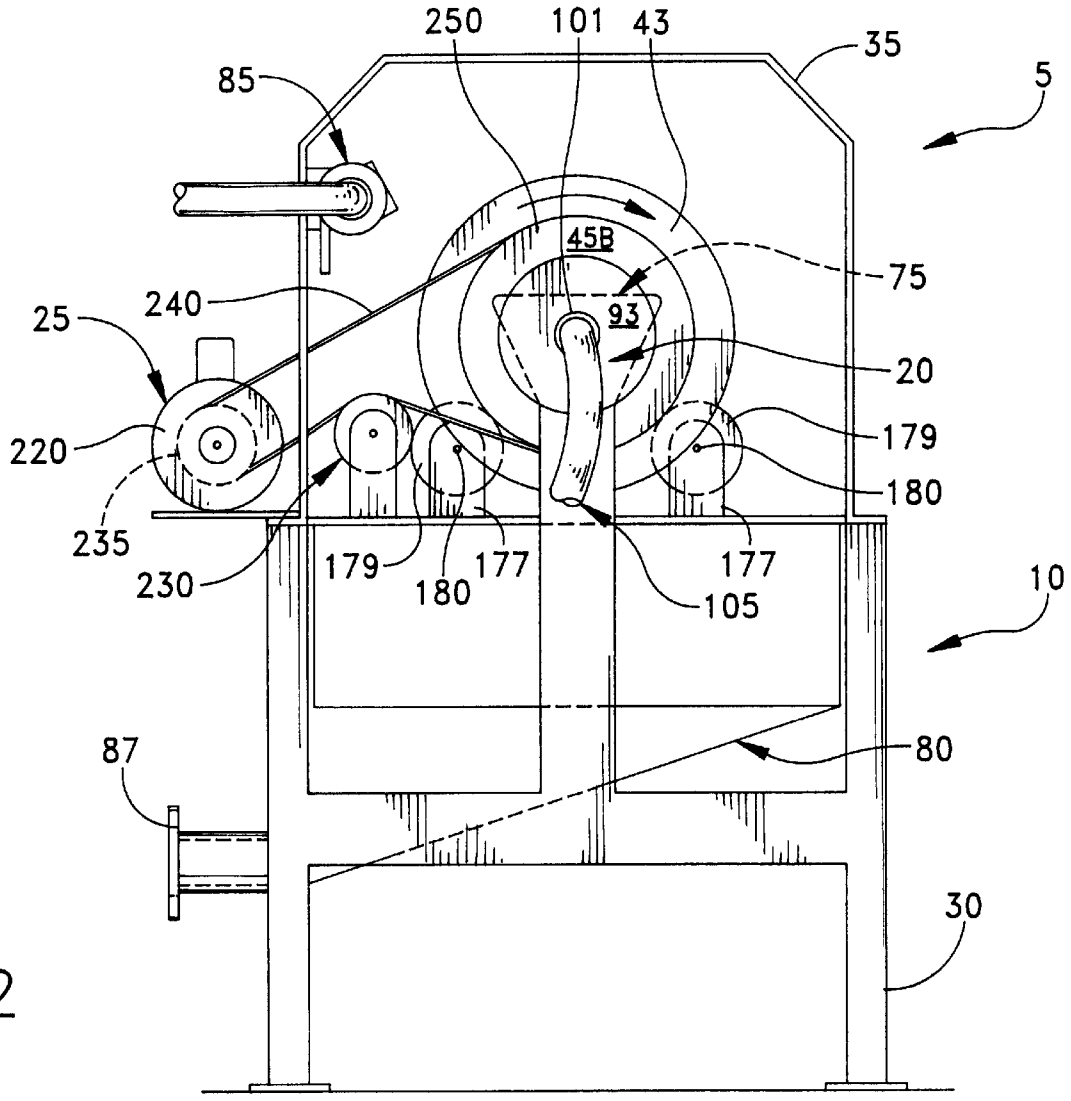
FIG. 2 is an elevational end view of the machine shown in FIG. 1, taken along line 2—2 in FIG. 1.
Figure 3:
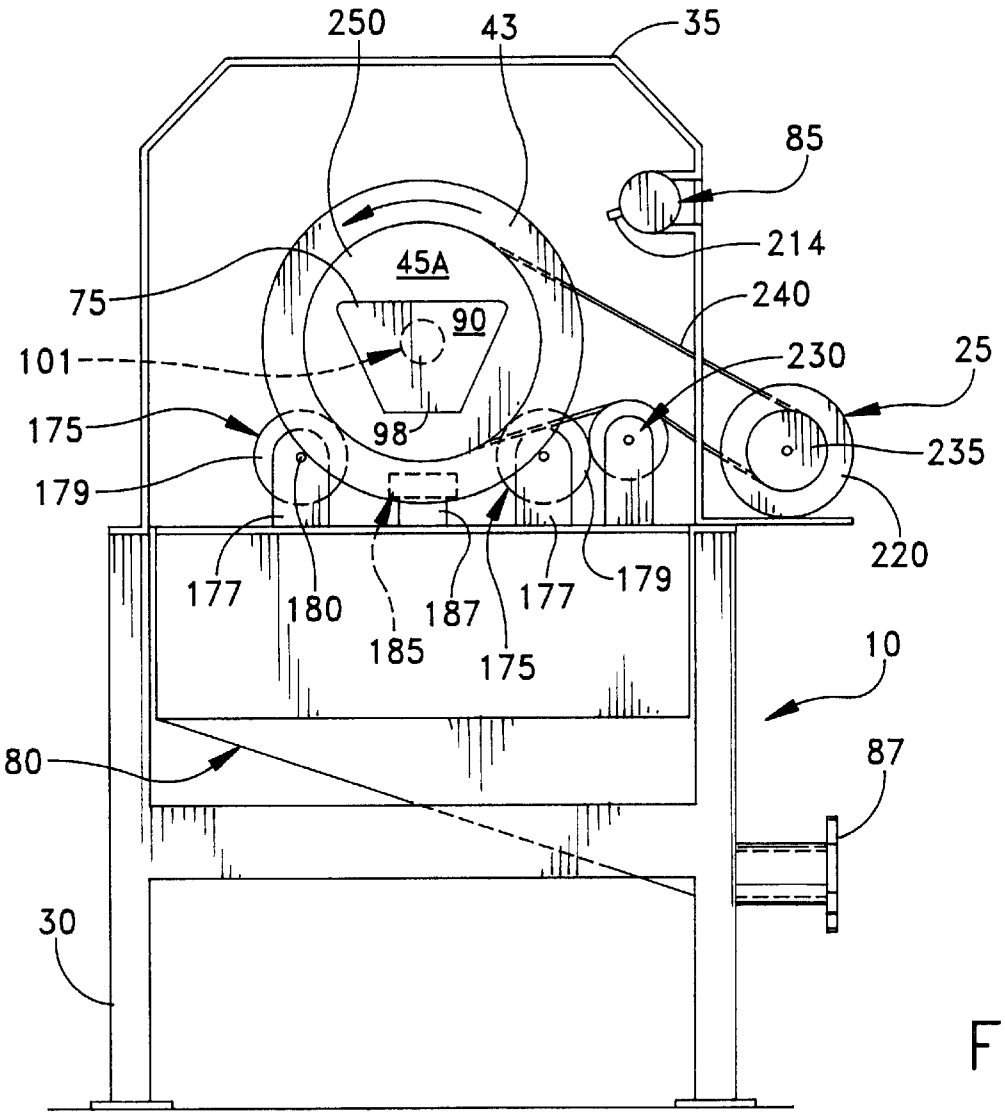
FIG. 3 is an elevational end view of the machine shown in FIG. 1, taken along line 3—3 in FIG. 1.
Figure 4:
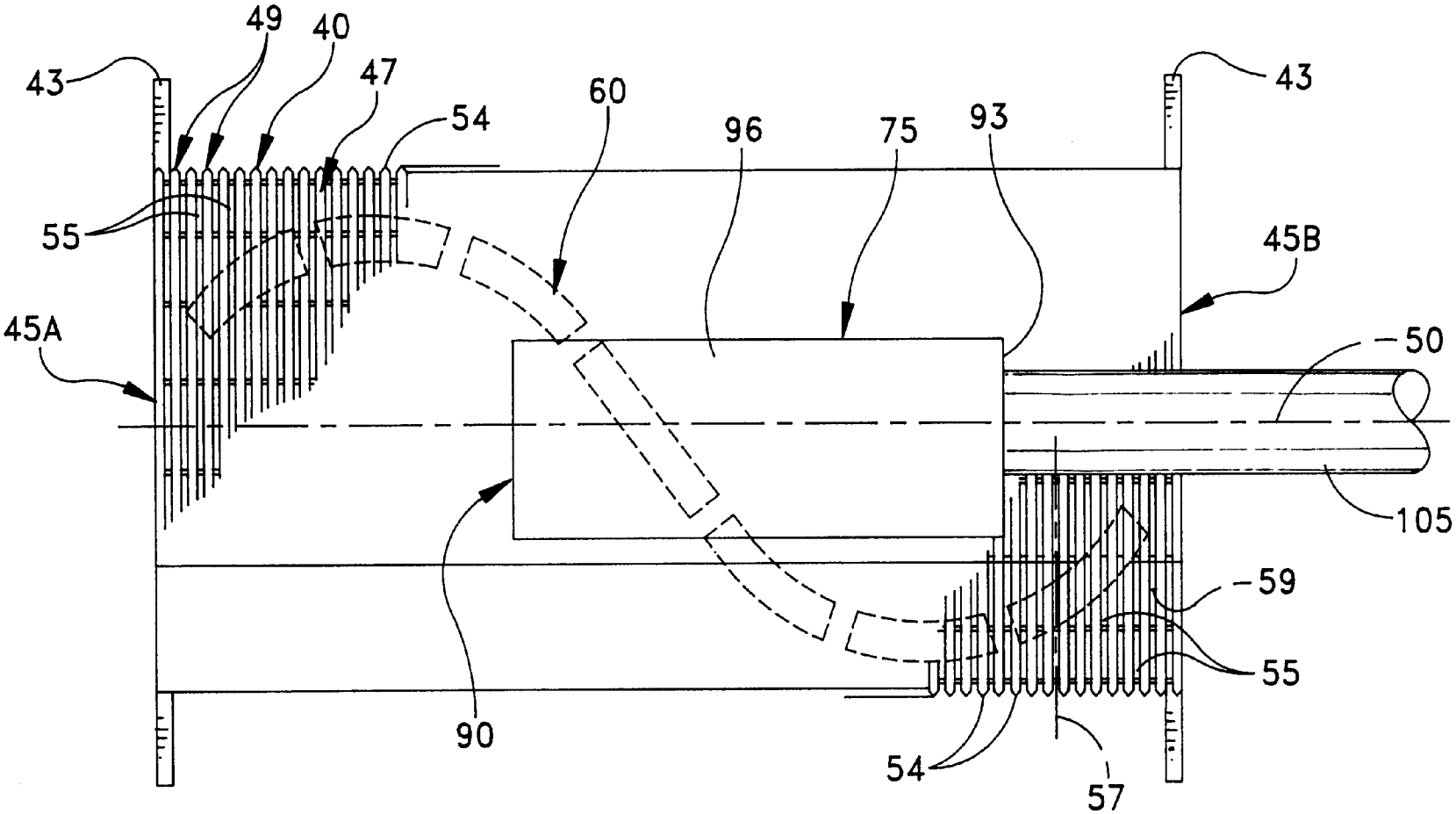
FIG. 4 is a side elevational view, partially broken-away and partially in phantom, of a screen cylinder formed in accordance with the invention.
Figure 5:
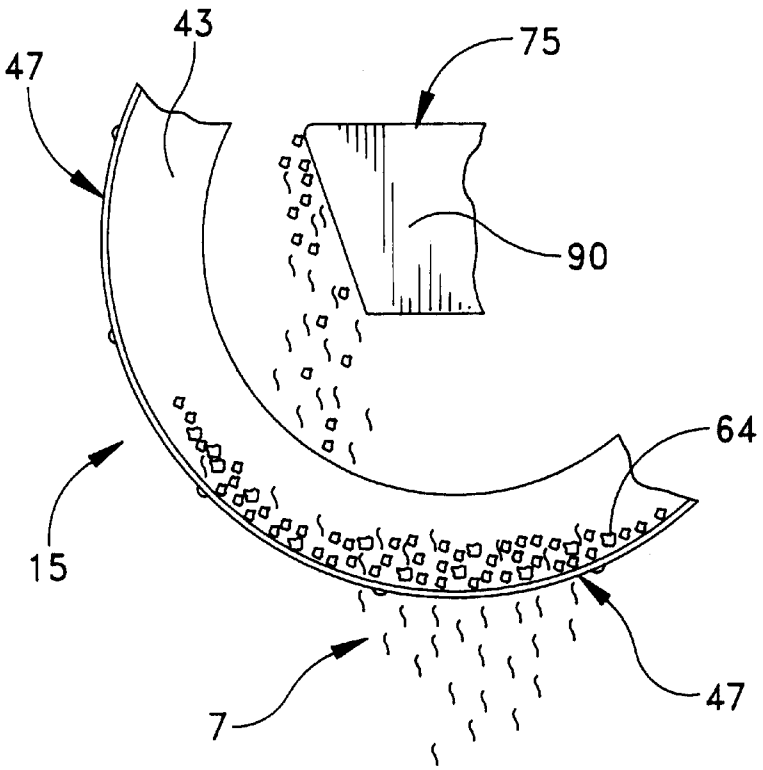
FIG. 5 is a schematic view representing debris separation from pulp according to the invention.

Referring to FIGS. 2, 3, and 4, slurry control means 20 provides a slurry delivery conveyor that comprises a headbox 75, an accept-collection sump 80, and a spray header 85. Headbox 75 is formed by a front wall 90, a rear wall 93, side wall weirs 96, and a bottom 98. Front wall 90, rear wall 93 and side wall weirs 96 form an upwardly facing open container, defining an open face opposite bottom 98. Rear wall 93 further includes an opening 101 adapted to interconnect with a slurry delivery conveyor feed pipe 105. Front and rear walls 90,93 preferably comprise a trapezoidal shape, as seen in FIGS. 2 and 3, so as to allow for a free flow of slurry (pulp fiber 7, debris 64, and water) over the edge of side wall weirs 96 of headbox 75 (FIG. 5). Accept-collection sump 80 is mounted below screen cylinder 15, on support 10. Accept-collection sump 80 is adapted to receive the filtered slurry after it passes through wall 40. An outlet opening 87 is disposed at a bottom portion of accept-collection sump 80 for connection to a conduit or the like for conveying the recovered fibrous slurry to a further processing apparatus. Of course, it will be understood that as machine 5 is scaled-up to larger models, an accept-collection sump will not necessarily be required.

Spray header 85 is mounted within splash hood 35 in confronting relation to the outwardly facing surface of wall 40. Spray header 85 comprises an elongated tube 213 having spray nozzles 214 disposed transversely to the longitudinal axis of tube 213, and directed toward the outwardly facing surface of wall 40. An on/off valve 215 is interconnected with a source of water, and is activated by valve control and regulation means, such as a manual or automatic operator. During operation of machine 5, spray header 85 is intermittently or continuously activated to dislodge debris 64 that has been caught in openings 55, together with any fiber caught together with the debris.

Screen cylinder 15 is rotatably mounted on support 10 and is disposed within splash hood 35. Rotational supports 175 are positioned in contact with the outer surface of wall 40, preferably adjacent to end flange 43, and provide rotational support and stability to screen cylinder 15 as it turns about rotation axis 50. Each support 175 comprises a pair of parallel brackets 177 and a conventional wheel 179 rotatably disposed on a shaft 180 located between brackets 177. An axial positioning trunnion 185 is positioned in contacting relation to at least one flange 43 of screen cylinder 15. Axial positioning trunnion 185 is arranged on a upwardly projecting pivot shaft 187 within support 10.

Drive means 25 may comprise any of the various conventional devices that are adaptable to provide rotational movement to screen cylinder 15. For example, drive means 25 may comprise a conventional motor 220 disposed adjacent to one end of splash hood 35 on support 10, as shown in FIGS. 1, 2, and 3. A gearbox reducer may be used in combination with drive means 20 to allow for adjustment in speed and power consumption, as is known in the art. A drive tensioner 230 and a drive pulley 235 are interconnected, by a drive belt (or chain) 240, to a driven pulley 250 disposed adjacent to the outwardly facing surface of an end flange 43.

Machine 5 is operated by discharging slurry containing debris 64, water, and pulp fiber 7 into the interior of screening cylinder 15. More particularly, drive means 25 is first actuated so as to cause screening cylinder 15 to rotate. Slurry is deposited by slurry control means 20 into headbox 75. Headbox 75 fills with slurry until the slurry begins to cascade over side wall weirs 96 and into contact with wall 40 of screening cylinder 15.

It will be understood that operating temperature has little effect on the performance of machine 5, so long as the carrier liquid is neither frozen nor completely vaporized. Also, screening cylinder 15 rotates at low RPM's and is held in position by axial positioning trunnions 185. The direction of flow from headbox 75 also could be altered to effect flow capacity. It will be understood that the vertical angle of screening cylinder 15 may be varied, relative to its preferred horizontal position, so as to vary the dryness of rejected material. A combination of materials and/or opening orientations may also be used to allow, for example, the ability to change from screening to drying zones.

The preferred orientation of screen 47 (i.e., wires 49 disposed in mutually parallel, circumferential-relation about rotation axis 50 of screen cylinder 15) take advantage of the fact that hydrated pulp fiber has a tendency to align itself (in a longitudinal sense) with the direction of flow of the hydrating liquid. This effect is particularly pronounced in a fluidized fibrous slurry. Unlike prior art screening devices, this preferred orientation of the fiber, and the advantageous orientation of plurality of openings 55, facilitates the passage of the fibers through screening cylinder 15. More particularly, as the slurry flows over side wall weirs 96 of headbox 75, fibers 7 orient themselves so as to be longitudinally aligned with the direction of flow of the slurry. The flowing slurry contacts wall 40 at a substantially radial orientation, such that the fibrous pulp passes readily through the plurality of openings 55 while the entrained debris remains trapped on the interior of rotating screening cylinder 15. The fibrous pulp and water is collected in accept-collection sump 80 where it is transferred to a holding tank, or the like, for further processing.

Slurry control means 20 can feed the slurry to the interior of screening cylinder 15 by gravity feed only, without further flow assistance. It has been found that flow rates for a single unit may vary from between 25 to 10,000 gallons per minute and that the flow rate is preferably dictated by the size of openings 55 and the size of screen cylinder 15. No pressure or vibration is required for substantially complete removal of debris from the fiber-containing slurry, even at very low concentrations of fiber. Screening cylinder 15 of machine 5 provides its most optimum effect on fibrous slurry that contains about one percent (1%) pulp fiber by weight.

Figure 7:
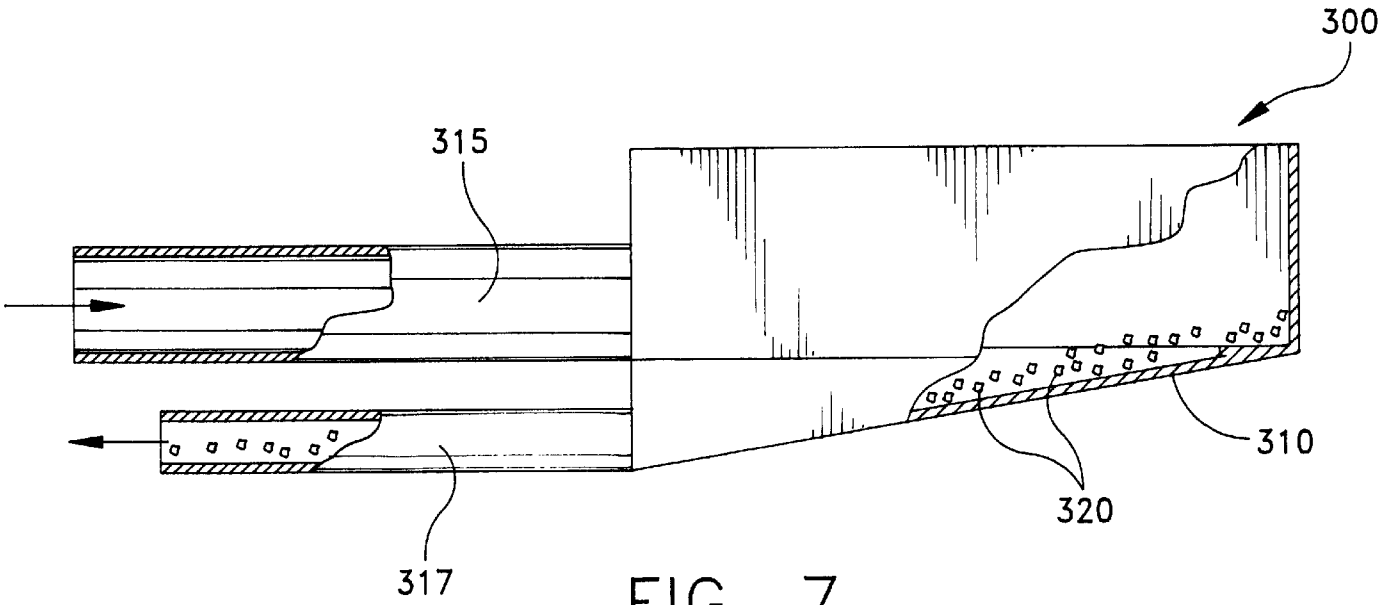
FIG. 7 illustrates an alternative embodiment of a headbox weir.

It will be understood that various modifications and changes to the foregoing structure are possible without departing from the scope or spirit of the invention. For example referring to FIG. 7, a junk trap headbox 300 allows for heavy contaminants 310 to be separated and removed from the normal slurry flow. Such heavy contaminants might comprise, e.g., sand and grit and tramp metal in a paper pulping slurry. In this embodiment, the area of junk trap headbox 300 is greater than an equal length of feed pipe 315, therefore, the flow velocity into screening cylinder 15 is substantially reduced. Junk trap headbox 300 is similar in construction to headbox 75, inasmuch as it comprises five closed sides and an open upper face. However, trap headbox 300 includes a sloping bottom 320 to allow the heavy contaminants to move, by gravity feed and water flow, toward discharge port 317. As a result of this construction, contaminants that are heavier than the carrier fluid sink to sloped bottom 320 of trap headbox 300 and are guided toward heavy debris discharge port 310.

Figure 8:
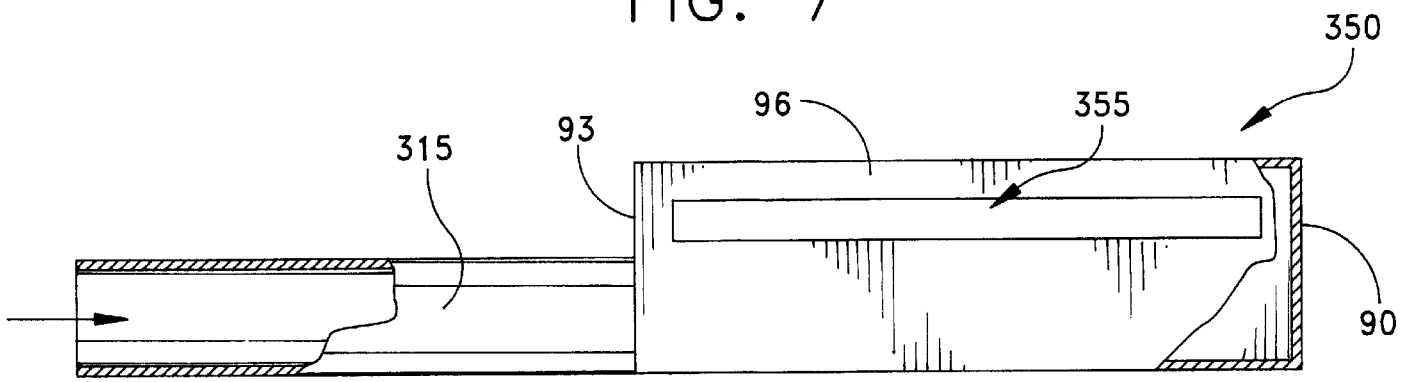
FIG. 8 shows another alternative embodiment of a headbox weir.

Alternatively, a high velocity headbox 350, shown in FIG. 8, comprises a pair of headbox outflow slots 355 formed in side wall weirs 96. In this embodiment, slurry may be caused to impinge wall 40 of screening cylinder 15 at an angle that approaches approximately ninety degrees (90°), by placing the influent slurry under pressure. The entrained fiber will still tend to orient itself in line with the outwardly directed flow of the slurry. In this way, the slurry will impinge upon wall 40 such that the entrained and oriented fiber will pass easily through wall 40.

It is to be understood that the present invention is by no means limited only to the particular constructions herein disclosed and shown in the drawings, but also comprises any modifications or equivalents within the scope of the appended claims.

What is claimed is:

1. Apparatus for separating contaminants from a fibrous slurry comprising:

a rotatable drum having an axis of rotation and a circumferential wall including a screen formed by a plurality of circumferential mutually parallel wedgewires oriented so that (i) a broad surface of each of said wedgewires is directed radially inwardly toward said central axis, and (ii) a narrow edge of each of said wedgewires is directed radially outwardly, and wherein a plurality of mutually parallel openings are defined between said wedgewires, each of said openings having a longitudinal axis which is large relative to the transverse axes of said openings, said openings being disposed with their longitudinal axes extending substantially circumferentially relative to the rotatable drum, said drum having at least one open end;

a slurry delivery conveyor terminating adjacent the drum for delivery of slurry within the drum so that a portion of said slurry flows onto said broad surfaces of said wedgewires.

2. Apparatus according to claim 1 wherein said openings flare open radially outwardly relative to said rotation axis.

3. Apparatus according to claim 1 wherein said drum further includes an auger disposed on said broad surface of said plurality of wedewires forming said circumferential wall.

4. Apparatus according to claim 1 wherein said slurry delivery conveyor is disposed in fluid communication with a headbox positioned within said drum.

5. Apparatus according to claim 4 wherein said head box includes an access port interconnected to a feed pipe and extending into said drum from said slurry delivery conveyor.

6. Apparatus according to claim 5 wherein said headbox comprises a length that is substantially equal to said feed pipe and also includes a sloped inner bottom surface that leads to a discharge port.

7. Apparatus according to claim 4 wherein said headbox includes side wall weirs each defining a longitudinally extending slot.

8. Apparatus according to claim 1 further comprising a splash hood at least partially surrounding said drum with a spray header mounted on an interior surface of said splash hood, said spray header comprising an elongate tube having a plurality of spray nozzles disposed in transverse relation to the longitudinal axis of said tube and directed toward said narrow edges of each of said wedgewires wherein said spray header is interconnected to a source of pressurized water.

9. Apparatus according to claim 1 wherein said drum is rotatably mounted on support means comprising at least two rotational supports disposed in contact with a surface of said drum.

10. Apparatus according to claim 9 wherein an axial positioning trunnion is mounted on said support means and in contact with a side edge of said drum.

11. Apparatus according to claim 5 wherein said slurry conveyor delivers said slurry to said interior of said drum by gravity.

12. Apparatus according to claim 11 wherein a flow rate of the slurry through said headbox ranges between about 25 and about 10,000 gallons per minute.

13. Apparatus for screening fibrous slurry comprising:

a rotatable drum having a central axis and a circumferential wall forming a screen from a plurality of mutually circumferential parallel wedgewires oriented so that (i) a broad surface of each of said wedgewires is directed radially inwardly toward said central axis, and (ii) a narrow edge of each of said wedgewires is directed radially outwardly, and wherein a plurality of openings with mutually parallel longitudinal axes which are large relative to the transverse axes of said openings, said openings being disposed with their longitudinal axes extending circumferentially of said central axis of the drum, the drum having at least one open end; and, a slurry delivery conveyor having a feed pipe terminating adjacent to a junk trap positioned within said drum for delivery of said slurry within said drum, said junk trap comprising a vessel having a plurality of closed sides, an open upper face, and a length substantially equal to or greater than the length of said slurry feed pipe and a downwardly inclined bottom surface whereby contaminants congregate and are guided by said inclined bottom surface to a discharge port.

14. Apparatus for screening fibrous slurry comprising:

a rotatable cylindrical drum having a central axis of rotation and a slurry delivery conveyor having a discharge within said drum;

said drum comprising a circumferential wall including a screen formed by a plurality of circumferential mutually parallel wedgewires oriented so that (i) a broad surface of each of said wedgewires is directed radially inwardly toward said central axis, and (ii) a narrow edge of each of said wedgewires is directed radially outwardly, and wherein a plurality of mutually parallel openings with longitudinal axes that are relatively larger and transverse axes that are relatively smaller, said longitudinal axes of said openings being positioned circumferentially of said drum and said transverse axes being positioned longitudinally of said drum so that a portion of said fibrous slurry flows onto said broad surfaces in a direction that is substantially parallel to said transverse axes of said openings.

15. A high efficiency filter for separating unwanted contaminants from a fibrous slurry comprising:

a vessel rotatable about a rotation axis and adapted to receive slurry containing paper pulp, a plurality of openings in a wall of said vessel wherein said wall is radially spaced from said rotation axis, said openings being defined between a plurality of circumferential mutually parallel wedgewires oriented so that (i) a broad surface of each of said wedgewires is directed radially inwardly toward said rotation axis, and (ii) a narrow edge of each of said wedgewires is directed radially outwardly, and wherein said wedgewires comprise longitudinal axes which extend in a direction of rotation of said wall around the rotation axis, and transverse axes defined across said broad surfaces which are shorter than said longitudinal axes, extend parallel to said rotation axis of said vessel, and are substantially wider than said narrow edges;

at least one end of said vessel being open for discharge of slurry therefrom after separation of said contaminants from said slurry.

16. Apparatus for separating unwanted contaminants from a fibrous slurry comprising:

a rotatable drum having a circumferential wall, said wall including a screen formed by a plurality of mutually parallel circumferential wedgewires oriented so that (i) a broad surface of each of said wedgewires is directed radially inwardly toward said central axis, and (ii) a narrow edge of each of said wedgewires is directed radially outwardly, and wherein a plurality of openings having longitudinal axes which are large relative to the transverse axes of said openings, said openings being disposed with their longitudinal axes extending circumferentially of the drum, said drum having at least one open end; and, a slurry delivery conveyor having a feed pipe terminating adjacent a junk trap positioned within said drum for delivery of said slurry within said drum, said junk trap comprising a vessel having a plurality of closed sides, an open upper face, and a length substantially equal to or greater than the length of said slurry feed pipe and a downwardly inclined bottom surface whereby contaminants congregate and are guided by said inclined bottom surface to a discharge port.

17. Apparatus for separating contaminants from a fibrous slurry comprising:

a rotatable drum having an axis of rotation and a circumferential wall including a screen formed by a plurality of circumferential mutually parallel wires oriented so that a broad surface of each of said wires is directed radially inwardly toward said central axis, wherein a plurality of mutually parallel openings are defined between said wires, each of said openings having a longitudinal axis which is large relative to the transverse axes of said openings, said openings being disposed with their longitudinal axes extending substantially circumferentially relative to the rotatable drum, said drum having at least one open end; and a slurry delivery conveyor terminating adjacent the drum for delivery of slurry within the drum so that a portion of said slurry flows onto said broad surfaces of said wedgewires.

18. Apparatus according to claim 17 wherein said plurality of wires comprise a circular cross-sectional shape.

19. Apparatus according to claim 17 wherein said plurality of wires comprise a rectilinear cross-sectional shape.

20. Apparatus according to claim 17 wherein said plurality of wires comprise a tear-shaped cross-section.

* * * * *